US010301803B2

(12) United States Patent
Beck et al.

(10) Patent No.: US 10,301,803 B2
(45) Date of Patent: May 28, 2019

(54) PUSH-TYPE DRAIN STOPPER FOR POP-UP DRAIN

(71) Applicant: PF Waterworks LP, Houston, TX (US)

(72) Inventors: Harold Kent Beck, Copper Canyon, TX (US); Sanjay Ahuja, Katy, TX (US)

(73) Assignee: PF Waterworks LP, Houston, TX (US)

( * ) Notice: Subject to any disclaimer, the term of this patent is extended or adjusted under 35 U.S.C. 154(b) by 0 days.

(21) Appl. No.: 15/584,030

(22) Filed: May 2, 2017

(65) Prior Publication Data

US 2017/0314244 A1 Nov. 2, 2017

Related U.S. Application Data

(60) Provisional application No. 62/330,783, filed on May 2, 2016, provisional application No. 62/474,058, filed on Mar. 20, 2017.

(51) Int. Cl.
*E03C 1/23* (2006.01)
*E03C 1/262* (2006.01)

(52) U.S. Cl.
CPC ..... *E03C 1/2306* (2013.01); *E03C 1/262* (2013.01); *E03C 2001/2317* (2013.01)

(58) Field of Classification Search
CPC . E03C 1/22; E03C 1/23; E03C 1/2302; E03C 2001/2311; E03C 2001/2313; E03C 2001/2315; E03C 2001/2317; A47K 1/14
USPC ..... 4/689, 691, 692
See application file for complete search history.

(56) References Cited

U.S. PATENT DOCUMENTS

| | | | | |
|---|---|---|---|---|
| 3,220,695 | A | 11/1965 | Downey et al. | |
| 3,366,980 | A | 2/1968 | Petursson et al. | |
| 3,428,295 | A | 2/1969 | Downey et al. | |
| 3,453,667 | A * | 7/1969 | Politz | E03C 1/23 4/295 |
| 4,007,500 | A | 2/1977 | Thompson et al. | |
| 4,381,569 | A | 5/1983 | Ingram | |
| 4,807,306 | A | 2/1989 | Hayman et al. | |
| 6,341,391 | B1 * | 1/2002 | Cheng | E03C 1/23 4/287 |
| 6,484,330 | B2 * | 11/2002 | Gray | E03C 1/0401 4/676 |

(Continued)

OTHER PUBLICATIONS

Website found at www.pfisterfaucets.com/innovations/push-and-seal; 4 pgs.; Jul. 31, 2018.

*Primary Examiner* — Janie M Loeppke
(74) *Attorney, Agent, or Firm* — Stephen S. Hodgson

(57) ABSTRACT

A push-type drain stopper is usable in a drain pipe that has a pivot rod port surrounded by a stub by sealing a rod that protrudes into the pipe through the stub. The stopper is pressed transversely into engagement with the rod, which is an anchor. The drain pipe has a drain flange that seals around a drain opening in a sink. If the flange becomes worn and unsightly or if one desires to change a color scheme for the sink, a cap that has a diameter greater than the drain flange hides the drain flange from sight. A retrofit kit includes the drain stopper, pivot balls sized to fit different pop-up drain assemblies, a rod that passes through the ball into the drain pipe, and a wing nut fixed to an end of the rod for tightening the rod against a stub cap.

30 Claims, 3 Drawing Sheets

(56) References Cited

U.S. PATENT DOCUMENTS

| | | | | |
|---|---|---|---|---|
| 7,320,336 | B2 * | 1/2008 | Herring | A47K 1/14 137/514 |
| 8,117,689 | B2 * | 2/2012 | Slayton | A47K 1/02 4/516 |
| 8,499,376 | B2 * | 8/2013 | Kyung Kim | E03C 1/2306 4/287 |
| 2010/0024108 | A1 * | 2/2010 | Yang | E03C 1/23 4/295 |
| 2011/0138527 | A1 | 6/2011 | Sienna et al. | |
| 2011/0185494 | A1 | 8/2011 | Beck et al. | |
| 2013/0042398 | A1 | 2/2013 | McLeod | |
| 2013/0269100 | A1 | 10/2013 | Ball et al. | |
| 2016/0130793 | A1 | 5/2016 | Lesmeister | |

* cited by examiner

FIG. 2
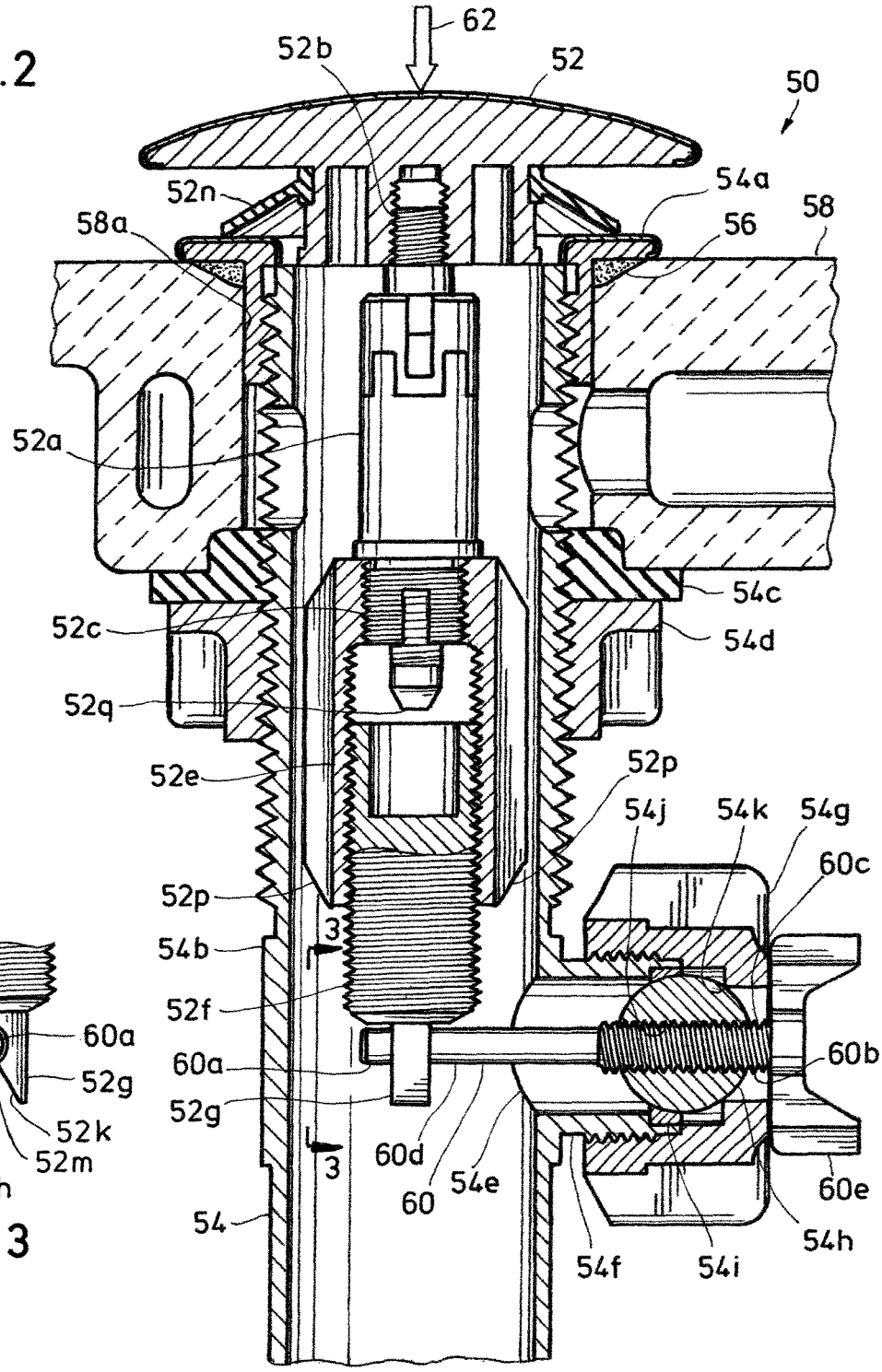
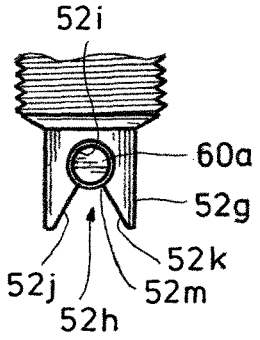
FIG. 3

PUSH-TYPE DRAIN STOPPER FOR POP-UP DRAIN

CROSS REFERENCE TO RELATED APPLICATIONS

This application claims priority to and the benefit of U.S. Provisional Patent Application Ser. Nos. 62/330,753, filed May 2, 2016, and 62/474,058, filed Mar. 20, 2017, each of which is incorporated by reference. U.S. patent application Ser. No. 15/584,032, filed May 2, 2017, is a related application.

BACKGROUND OF THE INVENTION

1. Field of the Invention

This present invention pertains to a pop-up drain assembly used to retain fluid in and release fluid from a sink or basin and more particularly to retrofitting a pop-up drain assembly to make it a push-type drain assembly.

2. Description of the Related Art

In a lavatory or bathroom sink or basin equipped with a supply of running water for washing oneself, a pop-up drain assembly allows one to retain water in the sink or basin and then release the water to flow by gravity downwardly through a drain pipe. The sink or basin has an opening at a lowermost point, and a typical pop-up drain assembly comprises a drain conduit sealingly fastened to the sink or basin within the opening. A drain stopper is received in the drain conduit for sealing the opening and retaining water in the sink or basin. A pivot rod protrudes into the drain conduit and engages a bottom portion of the drain stopper. A lift rod is connected to the pivot rod. One can pull the lift rod up to pull the drain stopper down for sealing the opening in the bottom of the sink or basin for retaining water, and one can push the lift rod down to raise the drain stopper, which unseals the drain stopper and allows water to drain from the sink or basin. U.S. Pat. No. 4,807,306, issued to Hayman et al., illustrates quite well the components in a typical prior art pop-up drain assembly and is incorporated by reference for all purposes.

Another drain assembly is known as a push-type drain assembly, which has a push-push drain stopper. A first push downwardly on the top of a drain stopper moves the stopper into a closed position. A second push moves the stopper into an open position. U.S. Pat. No. 3,220,695, issued to Downey et al. on Oct. 13, 1961, describes what is titled as a "Push-Button Drain Valve." U.S. Pat. No. 3,366,980, issued to Petursson et al. on Apr. 16, 1965, describes a different push-type drain stopper. The Pfister plumbing company sells a drain assembly called Push & Seal as an alternative to a pop-up drain assembly. The Push & Seal drain assembly has a drain pipe that is received in a sink drain opening, a gasket and nut for sealing the drain pipe in the sink, and a push-type drain stopper that is received in the drain pipe in a threaded engagement with the drain pipe.

SUMMARY OF THE INVENTION

A push-type drain stopper includes in one embodiment a push-push, mechanism having upper and lower ends; a cap attached to the upper end; and a two-pronged fork having a fixed end and a free end, where the fixed end is attached directly or indirectly to the lower end of the push-push mechanism. Each of the prongs has an angled end at the free end such that the two prongs form a V-shape that points toward the push-push mechanism. Each of the prongs has a semi-circular notch adjacent to the angled end such that the two prongs define a circular hole. The V-shape has a pointed end, which is adjacent to the circular hole. The push-push mechanism and the cap each have a diameter, and the diameter of the cap is preferably greater than twice the diameter of the push-push mechanism. The push-push mechanism in one embodiment includes a coupling attached to the lower end and a nipple attached to the coupling, and the two-prong fork is attached to the nipple.

In another embodiment, a push-type drain assembly for a sink having a drain opening includes a drain pipe attached to the sink at the drain opening, where the drain pipe has a port and a stub surrounding the port, where the longitudinal axis of the stub is transverse to the longitudinal axis of the drain pipe; a rod passing through the port and protruding into the drain pipe transverse to the longitudinal axis of the drain pipe; and a push-type drain stopper received in the drain pipe and connected to the rod, where the stopper is moveable between an open position and a closed position by pushing on the stopper. In one embodiment, a ball having a bore is received and held in the stub, and the rod passes through the ball. The drain stopper preferably includes a push-push mechanism that has upper and lower ends; a cap attached to the upper end; and a two-pronged fork attached to the lower end, where the two-prong fork is pressed onto the rod transversely and engaged with the rod in a snap fit.

BRIEF DESCRIPTION OF THE DRAWINGS

A better understanding of the invention can be obtained when the detailed description of exemplary embodiments set forth below is considered in conjunction with the attached drawings in which:

FIG. 2 is a cross-section of a side elevation of a pop-up drain assembly, which has been retrofitted with a push-type drain stopper, according to the present invention.

FIG. 3 is a side elevation of the pop-up drain assembly as seen in the view 3-3 in FIG. 2.

DETAILED DESCRIPTION OF THE EXEMPLARY EMBODIMENTS

Figure 1:
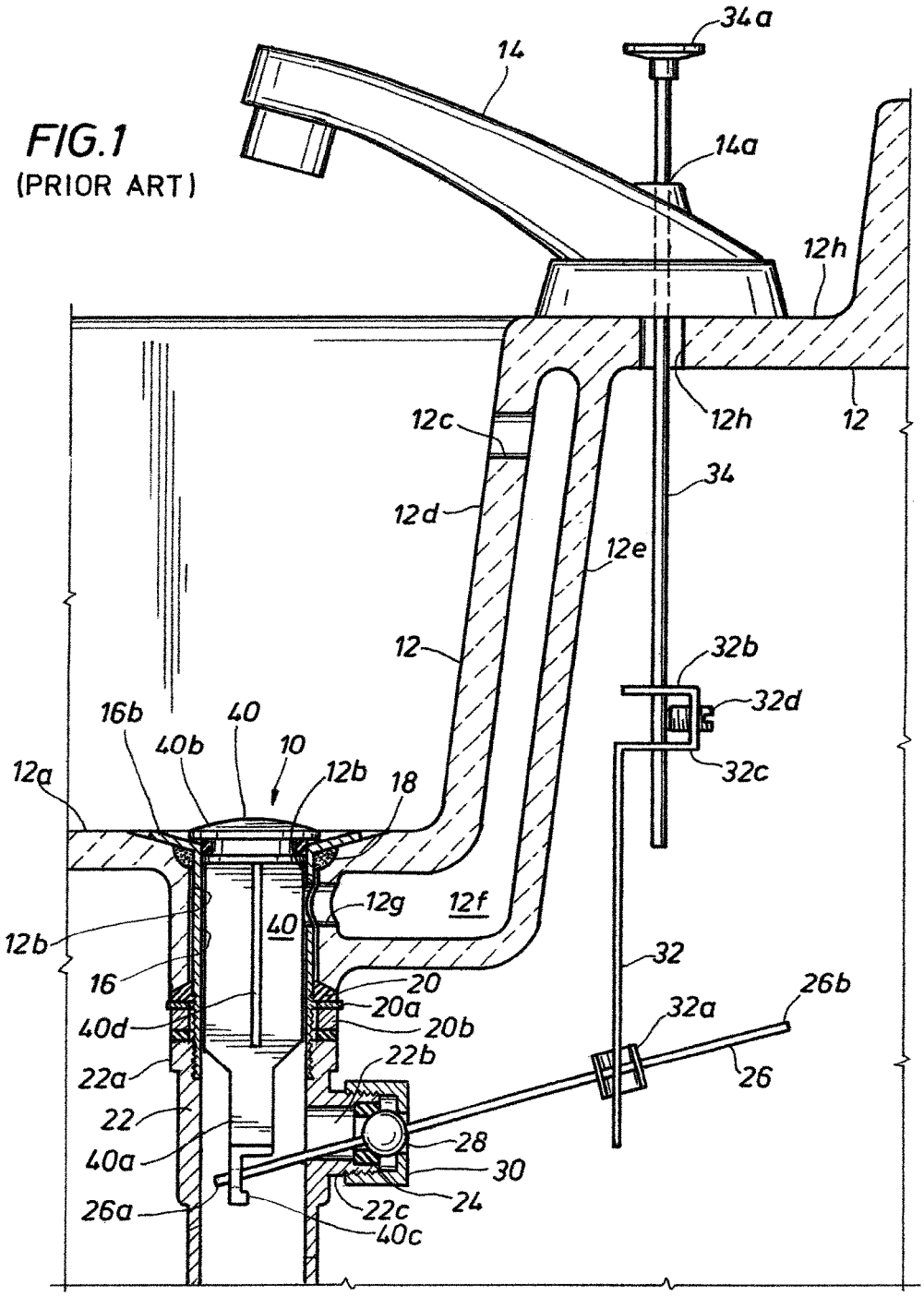
FIG.1 (PRIOR ART)
FIG. 1 is a cross-section of a side elevation of a sink or basin and a prior art pop-up drain assembly.

FIG. 1 is side elevation in cross-section of a prior art pop-up drain assembly 10 in a sink or basin 12. A drain opening is provided in a lowermost portion of the sink or basin for draining the fluid. The pop-up drain assembly includes piping that can be placed through the drain opening and fastened to the sink or basin. The piping is typically connected to a drain pipe, and the piping provides a fluid flow pathway from the sink or basin through the drain opening and through the piping to the drain pipe for conveying fluid from the sink or basin to the drain pipe and away for disposal and/or treatment. After the drain assembly is installed on a sink, a drain stopper is received in the piping and is moveable between an open position and a closed position. In the closed position, the stopper provides a seal with the piping for retaining fluid in the sink or basin, and in the open position, fluid can enter the piping and drain away through the drain pipe. A pivot rod is used to move the stopper between the open position and the closed position. The pivot rod pivots about a generally horizontal position and engages the stopper, raising the stopper to the open position and lowering the stopper to the closed position.

The pop-up drain assembly 10 is received in the sink or basin 12, which is typical for a bathroom, restroom or lavatory. Sink 12 has a lower surface 12*a* that drains into a drain opening 12*b*. Sink 12 has an overflow port 12*c* in a side wall 12*d*, which is an optional feature. An outer wall 12*e* and side wall 12*d* define an overflow channel 12*f*, and side wall 12*d* has an overflow drain port 12*g* for draining overflow fluid into a port in drain assembly 10. A faucet 14 is mounted on a top deck 12*h* of sink 12 for supplying water or other fluid to sink 12.

A number of different manufacturers make and sell pop-up drain assemblies, which can be retrofitted to provide a push-type drain assembly according to the present invention. The pop-up drain assembly 10 in FIG. 1 comprises a drain flange 16 that fits down through drain opening 12*b* in sink 12. Drain flange 16 has a threaded tubular portion 16*a* extending essentially throughout its fall length and a flange 1.6*h* extends radially outwardly on a top end. A gasket or plumber's putty 18 provides a seal between the lower surface 12*a* of the sink 12 and the flange 16*b* of drain flange 16. A flexible gasket 20 and a washer 20*a* are placed around a bottom portion of drain flange 16 and then pressed tightly against a bottom surface of sink 12 with a threaded nut 20*b*. A drain body 22 is threaded onto a lower end of drain flange 16. Drain body 22 has a wrench flange 22*a* for receiving a wrench for tightening and loosening drain body 22 with respect to drain flange 16. Drain body 22 has a pivot rod port 22*b*, and a threaded tubular stub 22*c* projects radially outwardly from drain body 22. A pivot rod seal 24 is received in stub 22*c*.

A pivot rod 26 has a stopper end 26*a* and an outer end 26*b*. A pivot ball 28 is sealingly received on pivot rod 26 closer to stopper end 26*a* than outer end 26*b*. Pivot rod 26 is received in stub 22*c* such that stopper end 26*a* is inside the drain body 22, and the stopper ball 28 rests against pivot rod seal 24. A pivot rod cap 30 is threaded onto stub 22*c* sufficiently tightly to seal pivot ball 28 against pivot rod seal 24, but loose enough to allow pivot ball 28 and pivot rod 26 to pivot. An extension rod 32 having a plurality of holes, which are not shown, is received on outer end 26*b* of pivot rod 26 and held in place by a clip 32*a*. Extension rod 32 is bent so as to have two parallel portions 32*b* and 32*c* that are perpendicular to the longitudinal axis of the extension rod 32, and each of the two parallel portions has a hole through which a control rod 34 is received. Control rod 34 passes through a faucet port 14*a* and a sink control rod port 12*h*. Control rod 34 has a knob 34*a* at an upper end, and control rod 34 is fastened to extension rod 32 by a set screw 32*d*.

A stopper 40 is received in drain flange 16 and drain body 22. Stopper 40 has an elongate shaft 40*a* running its length, which has a longitudinal axis through the center of stopper 40. A cap 40*b* is located on an upper end while the drain assembly 10 is installed and operational, and a pivot rod receiving member 40*c* is located on an opposing lower end. The pivot rod receiving member 40*c* defines an opening through which stopper end 26*a* of pivot rod 26 protrudes for engaging and moving stopper 40, and pivot rod receiving member 40*c* may be referred to as open member 40*c*. Four flanges or fins, referred to collectively as fins 40*d*, extend longitudinally along shaft 40*a* and project radially, and fins 40*d* lie in two perpendicular and intersecting planes. The fins provide structural support for the shaft and center the stopper in the drain pipe. For more information, please see U.S. Patent Application Pub. No. 2011/0185494 A1, which was published on Aug. 4, 2011, which lists Beck and Ahuja as inventors, which is incorporated by reference.

Turning now to the present invention, FIG. 2 is a cross-section of a side elevation of a push-type drain assembly 50, according to the present invention. Prior art push-type drain assemblies used a drain pipe that is different from the drain pipe for a pop-up drain assembly. The drain body 22 in the prior art pop-up drain assembly in FIG. 1 has the pivot rod port 22*b* and the threaded tubular stub 22*c* that projects radially outwardly from drain body 22. A drain pipe for a push-type drain assembly does not have a pivot rod port. Also, a drain pipe for a push-type. drain assembly typically has threads or some other means for anchoring a push type drain stopper in the drain pipe. If one wanted to convert a pop-up drain assembly to a push-type drain assembly, one needed to remove the pop-up drain pipe and replace it with the push-type drain pipe. The present invention allows one to convert a pop-up drain assembly to a push-type drain assembly without the need to remove the pop-up drain pipe and replace it with the push-type drain pipe.

A push-type drain stopper 52 is received in a pop-up type drain pipe 54, according to the present invention. The pop-up type drain pipe 54 comprises a drain flange 54*a* and a drain tube 54*b*, which is in a threaded engagement with the drain flange 54*a*. Drain flange 54*a* is sealed with a plumber's putty 56 to a sink 58 in a drain opening 58*a*. A gasket 54*c* is pressed against the bottom of the sink 58 by a nut 54*d*, which seals the drain pipe 54 with the bottom of the sink 58. The drain pipe 54 has a port 54*e*, and a stub 54*f* surrounds the port 54*e*. A stub cap 54*g* is threaded onto stub 54*f* and presses a ball 54*h* against a seal 54*i*. The ball 54*h* has a threaded bore 54*j*. The drain tube 54*b*, the port 54*e* and the stub 54*f* are the same as or equivalent to the drain body 22, the port 22*b* and the stub 22*c* in the prior art pop-up drain assembly of FIG. 1. The drain pipe 54 is rigid between the drain flange 54*a* and the port 54*e*, and generally, all of the drain pipe 54 is rigid, but the drain pipe 54 may have a flexible portion downstream from the port 54*e*.

A rod 60 has an inside end 60*a* that inside drain tube 54*b* and an outside end 60*b* that is outside of the drain pipe 54. Rod 60 has a threaded portion 60*e* on and proximal to the outside end 60*b*. Rod 60 has a smooth-surface portion 60*d* on and proximal to the inside end 60*a*. Rod 60 passes through the threaded bore 54*j* and is threadedly engaged with the pivot ball 54*h*. A wing nut 60*e* is fixed to the outside end 60*b* of the rod 60. The stub cap 54*g* holds the ball 54*h* firmly in place while the seal 54*i* seals against water leakage. The wing nut 60*e* is tightened firmly against the stub cap 54*g*, which pulls the ball tightly against a shoulder 54*j* within the cap 54*g*. Alternatively, the wing nut 60*e* and the stub cap 54*g* can be combined into a single element. Further, the ball 54*h* can be eliminated and replayed with an alternative seal that prevents water leakage through the port. One of ordinary skill in this art will identify alternative means to fasten a rod to a stub that extends radially from a drain pipe around a pivot rod port in a prior art pop-up drain assembly such that the rod extends inside the drain pipe. The smooth-portion 60*d* of the inside end 60*a* of the rod 60 protrudes inside the drain tube 54*b* of the drain pipe 54. The inside end 60*a* protrudes just past the longitudinal axis of the drain tube 54*b* from the pivot rod port 54*e*. The inside end 60*a* does not protrude all the way to the far inside wall of the drain tube 54*b* from the port 54*e*. The rod 60 is transverse to the longitudinal axis of the drain tube 54*b* and is held tightly in position because the cap 54*g* holds the ball 54*h* in position, and the wing not 60*e* is fixed to the rod 60 and holds the rod 60. The rod 60 is preferably held at or about at a position that is perpendicular to the longitudinal axis of the drain tube 54*b*. The rod 60 serves as an anchor for the push-type drain stopper. Consequently, a pop-up drain assembly can be converted to a push-type drain assembly.

The push-type drain stopper 52 comprises a conventional push-push mechanism 52*a* that has a threaded upper end 52*b* and an opposing threaded lower end 52*e*, a cap 52*d* threaded onto the upper end 52*b*, a coupling 52*e*, which has a bore defined by female threads, having an upper end threadedly connected to the lower end 52*c* of the push-push mechanism 52*a*, a nipple 52*f* that has male threads, which is threaded into a lower end of the coupling 52*d*, and an anchor clasp 52*g* depending from a lower end of the nipple 52*f*, which is fixed to or formed integral with the nipple 52*f*. The anchor clasp 52*g* has a V-shaped indentation 52*h* on a lower end, which leads to a circular opening 52*i*. The V-shaped indentation is defined by two prongs 52*j* and 52*k*. The V-shaped indentation is as wide as the diameter of the rod 60 at a lower end and narrows into a small gap 52*m* between the prongs between the V-shaped indentation and the circular opening. The circular opening has a diameter that is slightly smaller than the diameter of the smooth-surface portion 60*d* of the rod 60. The anchor clasp 52*g* is made of a stiff, flexible and resilient material. The push-type drain stopper 52 is pressed onto the rod 60. The V-shaped indentation feeds the rod 60 into the circular opening. As the rod 60 passes through the gap, the prongs are pushed apart and then come back together as the rod settles into the circular opening, where the prongs tightly hold and fasten the push-type drain stopper 52 to the anchor rod 60, thereby anchoring the push-type drain stopper 52 to the anchor rod 60. A seal 52*n* presses against the drain flange 54*a* for providing a seal and holding water in the sink 58 while the push-type drain stopper 52 is in its closed position. The seal 52*n* is a downwardly-facing conical washer made of an elastomeric material.

The conventional push-push mechanism 52*a* comprises a hollow cylinder with a spring and ratchet mechanism inside, which holds the mechanism in two positions, namely an open position and a closed position. FIG. 2 shows the push-push mechanism in the closed position with the seal 52*n* pressed against the drain flange 54*a*. A push on the cap 52 in the direction of an arrow 62 pushes the end 52*b* into the body of the mechanism 52*a*, and, upon release of the cap, a spring inside the body of the mechanism 52*a* pushes the end 52 *b* away from the body, thereby moving the seal 52*n* away from the drain flange 54*a*. Another push closes the seal 52*n* against the drain flange 54*a*.

The coupling 52*e* has four centralizing fins 52*p*. The coupling 52*e* could be eliminated, and the nipple 52*f* could be designed to fasten directly to the push-push mechanism 52*a*. The push-push mechanism 52*a* has a lower portion 52*q* that moves up and down and in and out of the body of the push-push mechanism 52*a*. The coupling 52*e* accommodates this motion. Priority is claimed to U.S. Provisional Patent Application Ser. No. 62/330,783, filed May 2, 2016, which is incorporated by reference. The 62/330,783 Provisional includes a FIG. 3, which shows a push-type drain stopper that is very similar to the push-type drain stopper 52 in FIG. 2 of the present application. In the 62/330,783 Provisional, "a height adjustment [is shown in FIG. 3] that can permit the user to adjust the mechanism to different heights of drains." The coupling 52*e* and the nipple 52*f* provide this height adjustment. The nipple 52*f* can be screwed into the coupling 52*e* a desired amount in order to provide a desired overall length of the push-push mechanism 52*a* to accommodate different heights of drain pipe 54 from the drain flange 54*a* to the port 54*e*, because this height varies from one manufacturer to another.

The cap 52 could be replaced with a conventional cap such as the cap 40*b* on the stopper 40 in FIG. 1. However, cap 52 has a much larger-than-normal diameter as compared to the cap 40*b* in FIG. 1. The purpose of this larger-than-normal diameter is to cover the drain flange 54*a*. Cap 52 hides the drain flange 54*a* from view. Cap 52 is useful for hiding an unsightly drain flange from view, and cap 52 is useful for changing a color scheme for a faucet and drain set. A preferred color for a faucet and drain set may change over time. For example, a faucet and drain set may have been installed in the color of polished brass, and a new owner may wish to change the color to brushed nickel. The new owner may at the same time wish to change the drain assembly from a pop-up drain stopper to a push-type drain stopper. The cap 52 can be selected in the color of brushed nickel. An existing pivot rod like the rod 26 in FIG. 1 can be removed. A replacement or retrofit kit may contain several balls so as to have a ball 54*h* of the proper size to replace the pivot ball. The new ball 54*h* is placed in the existing stub 54*f* on the existing drain pipe 54, and the existing cap 54*g* holds the ball in place. The new rod 60 is threaded through the ball 54*h* until the wing nut 60 is tight against the cap 54*g*. It may not be necessary to replace an existing pivot rod because the existing pivot rod may work well enough as an anchor for the push mechanism 52*a*. The faucet 14 of FIG. 1 would be replaced by the new owner with a faucet haying a brushed-nickel finish, and the control rod 34 in FIG. 1 would be eliminated.

Figure 4:
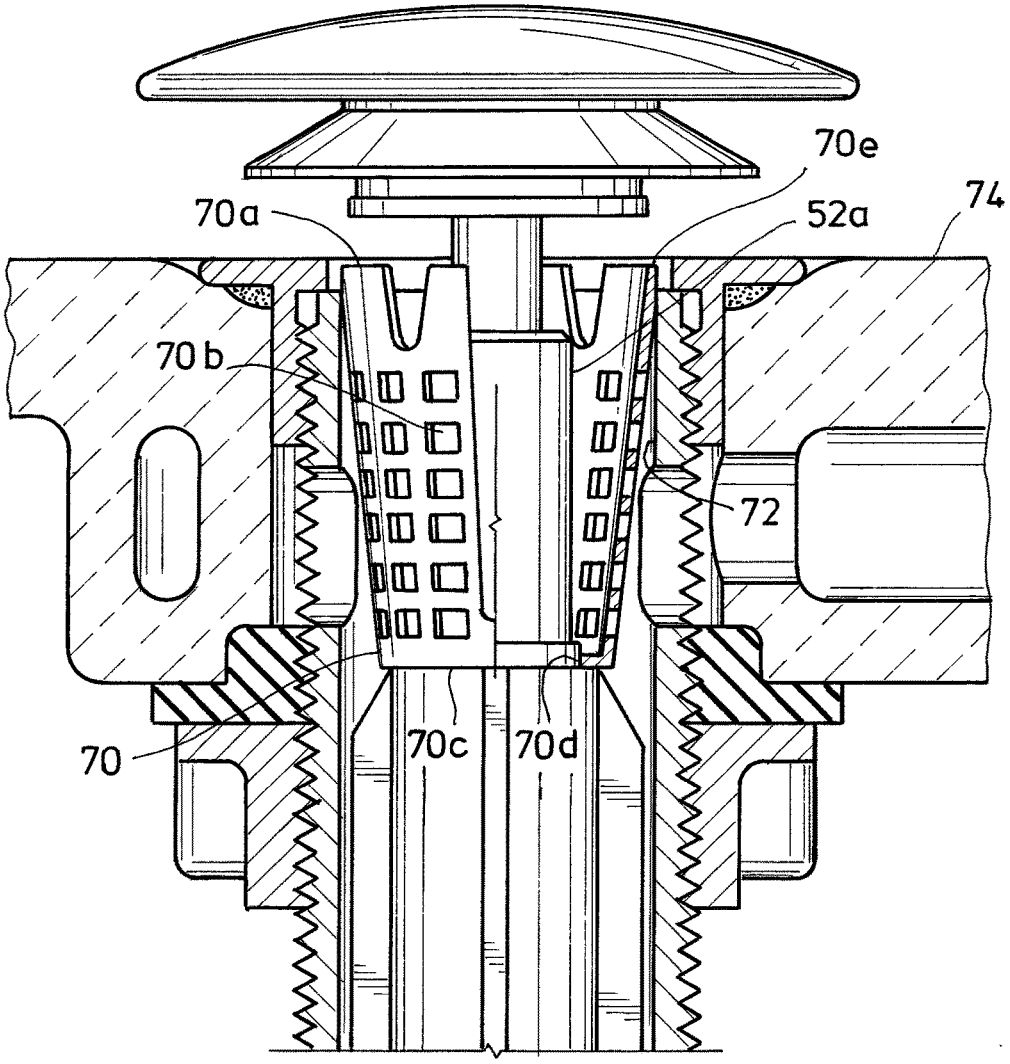
FIG. 4 is a side elevation in partial cross-section of push-type drain stopper with a strainer basket, according to the present invention.

FIG. 4 shows a strainer basket 70 can be placed around the push mechanism 52*a* for catching hair and other debris. The strainer 70 may have a generally cylindrical or frustoconical shape, an open upper end 70*a*, a plurality of holes 70*b*, openings and slots and a lower end or base 70*c*. The base 70*c* may have a generally circular opening 70*d* that is slightly smaller than the diameter of the push mechanism 52*a*. The diameter at the upper end 70*a* is greater than the diameter at the base 70*c*. The upper end 70*a* of the strainer 70 flares outwardly and has an outermost circumference proximate to an uppermost edge 70*e* , which is sized to fit snugly in a drain pipe 72 from a sink 74.

Priority is claimed to U.S. Provisional Patent Application Ser. No. 62/474,058, filed Mar. 20, 2017, which is incorporated by reference. The 62/474,058 Provisional states essentially the following. A side elevation of a strainer basket is shown in the drawings for removing hair and other debris from a drain fluid stream. The strainer has a generally cylindrical shape, an open upper end, a plurality of longitudinal slots and a partially closed lower end or base. Two longitudinal slots are shown, and two more slots are not shown. The strainer has a plurality of openings such as holes and slots through which water can pass and a plurality of obstructions on which hair and other debris tends to be caught and retained. The upper end of the strainer flares outwardly and has an outermost circumference proximate to an uppermost edge, which is sized to fit snugly in a drain pipe from a sink. The longitudinal slots extend nearly the entire length of the strainer. A fin of a drain stopper is received in a longitudinal slot, and there is a slot for each fin. A section of wall between two longitudinal slots has a V-shaped notch, which provides a wide opening along the upper edge, which narrows to a point at a lower end of the notch. The notches and the longitudinal slots allow the strainer basket to flare outwardly against an inside wall of a drain pipe and to be compressed inwardly to accommodate an inside diameter of a drain pipe that is smaller than the diameter of the strainer. A side elevation of the strainer after rotation about a longitudinal axis shows a single longitudinal slot. A side elevation of a drain stopper having a two-prong fork centered about the longitudinal axis of the stopper is shown in the drawings. The two-prong fork is a pivot rod retainer, which can be pressed transversely over a pivot rod for fastening the stopper to a pivot rod with a friction fit. A strainer is received on the stopper body. Water and debris, such as hair, from a sink flows inside the strainer and out through holes and slots in the strainer, except hair and other debris tends to be caught and retained inside the strainer.

The 62/474,058 Provisional also states essentially the following. The two prong fork engages the pivot rod in a friction fit. One prong is on one side of the pivot rod and the other prong on the other side of the pivot rod, and the pivot rod is squeezed between the two prongs, which applies a spring force on the pivot rod thereby holding the pivot rod in a friction fit. . . . The two-prong fork has a pair of opposing prongs that extend downwardly and parallel to one another. Opposing prongs have inside faces, and a gap is defined between the inside faces. The pivot rod is received in the gap.

A nonprovisional patent application has been filed by the present inventors, which claims priority to the 62/474,058 Provisional, and has been published as U.S. Patent Application Pub. No. 2018/0171610 A1 ("the '610 application"). The 62/474,058 Provisional states the following with reference to the figures in the '610 application, which are formal drawings of informal drawings in the 62/474,058 Provisional.

[With reference to the figures in the '610 application,] FIG. 1 shows the two-prong fork 32*b* in a side elevation. FIG, 2 shows the two-prong fork 32*b* in a front elevation. The two-prong fork 32*b* has a pair of opposing prongs 32*d* and 32*e* that extend downwardly and parallel to one another from the central body 32*a*. Opposing prongs 32*d* and 32*e* have inside faces 32*f* and 32*g*, and a gap 32*h* is defined between the inside faces 32*f* and 32*g*. The pivot rod 26 is received in the gap 32*h*. FIG. 3 is a cross-section of the two-prong fork 32*b* as seen along the line 3-3 in FIG. 2.

The connector device 32 is preferably made of polymeric materials. Opposing prongs 32*d* and 32*e* preferably comprise two different polymeric materials. As best seen in FIG. 3 [of the '610 application], each of the prongs 32*d* and 32*e* have outer T-shaped portions 32*i* and 32*j*, respectively, where the leg of the T-shape is positioned inwardly toward the gap 32*h* and the cap of the T-shape provides an outer surface. The T-shaped portions 32*i* and 32*j* are preferably made of a relatively stiff, but resilient, polymeric material. Each of the prongs 32*d* and 32*e* have an inner liner or insert 32*k*, which is less stiff and more resilient than the T-shaped outer portions 32*i* and 32*j*. For example, the T-shaped outer portions 32*i* and 32*j* may be made of an acrylonitrile butadiene styrene (ABS) material, while the inner liner or insert 32*k* may be made of a thermoplastic elastomer such as styrene butadiene rubber. Another example is that both the outer T-shaped portions 32*i* and 32*j* and the inner liner or insert 32*k* may be made of a styrene-butadiene-styrene (SBS) copolymer, where the outer T-shaped portions 32*i* and 32*j* are made with an SBS copolymer that has a relatively high styrene content and low butadiene content and the inner liner or insert 32*k* has relatively less styrene content and relatively more butadiene content. The inner liner or insert 32*k* is more rubbery than the outer T-shaped portions 32*i* and 32*j*. These portions of the prongs 32*d* and 32*e* work cooperatively to hold the pivot rod 26 in a friction fit. The outer T-shaped portions 32*i* and 32*j* provide stiffness and resiliency for applying a spring force for holding the pivot rod 26. The inner liner or insert 32*k* compresses and surrounds the pivot rod to some extent and provides a somewhat high-friction, preferably rubbery, surface for engaging and holding the pivot rod 26. FIG. 2 [of the '610 application] shows a partial cross-section of the prongs 32*d* and 32*e* and the inner liner or insert 32*k*, which shows indentations and protrusions between the inner liner or insert 32 and the prongs 32*d* and 32*e* for improving a bond between the inner liner or insert 32*k* and the prongs 32*d* and 32*e*.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A push-type drain assembly for a sink having a drain opening, comprising:

a drain pipe attached to the sink at the drain opening, wherein the drain pipe has an upper end, a port and a stub surrounding the port, wherein the drain pipe has a length between its upper end and the port, wherein the drain pipe has a longitudinal axis, and wherein the stub has a longitudinal axis that is transverse to the longitudinal axis of the drain pipe;

a rod passing through the port and protruding into the drain pipe, wherein the rod is fastened directly or indirectly to the stub, wherein the rod has a longitudinal axis that is transverse to the longitudinal axis of the drain pipe; and a push-type drain stopper received in the drain pipe and supported by the rod, wherein the drain stopper comprises a push-push mechanism that holds the drain stopper in one of two positions, wherein the two positions are an open position and a closed position, wherein the drain stopper has opposing upper and lower ends, wherein a push on the upper end of the drain stopper moves the drain stopper from the open position to the closed position and another push on the upper end of the drain stopper moves the drain stopper from the closed position back to the open position, and wherein the push-type drain stopper further comprises a means for accommodating the length of the drain pipe between its upper end and the port so that the push-type drain stopper can be used with drain pipes having different lengths between the upper end of the drain pipe and the port.

2. The push-type drain assembly of claim 1, further comprising a ball having a bore, wherein the ball is received and held in the stub, and wherein the rod passes through the ball.

3. The push-type drain assembly of claim 1, wherein the drain stopper comprises:

a cap attached to the upper end of the drain stopper; and a two-prong fork attached to the lower end of the drain stopper, wherein the two-prong fork is sized and designed to be pressed onto the rod transverse to the longitudinal axis of the rod, and wherein the means for accommodating the length of the drain pipe between its upper end and the port comprises the two-prong fork.

4. The push-type drain assembly of claim 1, wherein the upper end of the drain stopper comprises a cap, wherein the drain pipe has a drain flange above and surrounding the drain opening in the sink, wherein the drain flange has a diameter, and wherein the cap has a diameter that is greater than the diameter of the drain flange.

5. The push-type drain assembly of claim 1, wherein the push-push mechanism comprises a hollow cylinder and a spring and ratchet mechanism inside the hollow cylinder, wherein the spring and ratchet mechanism provides two positions for the push-push mechanism, thereby providing the open and closed positions for the drain stopper, and wherein the means for accommodating the length of the drain pipe between its upper end and the port comprises a combination of threaded elements that can be threaded together an additional amount to shorten the push-push mechanism and that can be threaded together a lesser amount to lengthen the push-push mechanism.

6. The push-type drain assembly of claim 1, wherein the upper end of the drain stopper comprises a cap, wherein the lower end of the drain stopper comprises a two-prong fork, wherein the means for accommodating the length of the drain pipe between its upper end and the port comprises a combination of threaded elements that can be threaded together an additional amount to shorten the push-push mechanism and that can be threaded together a lesser amount to lengthen the push-push mechanism, and wherein the two-prong fork is attached to the combination of threaded elements, or wherein the combination of threaded elements comprises the two-prong fork.

7. The push-type drain assembly of claim 6, wherein the push-push mechanism has opposing top and bottom ends, further comprising a coupling attached to the bottom end of the push-push mechanism and a nipple attached to the coupling, and wherein the two-prong fork is attached to the nipple.

8. The push-type drain assembly of claim 7, further comprising a ball having a bore; a stub cap; and a wing nut, wherein the ball is received and held in the stub by the stub cap, wherein the stub cap is threaded onto the stub, wherein the rod passes through and is received in the bore of the ball, and wherein the wing nut is fixed to an end of the rod and tightened against the stub cap.

9. The push-type drain assembly of claim 6, wherein the drain pipe has a drain flange above and surrounding the drain opening in the sink, wherein the drain flange has a diameter, and wherein the cap has a diameter that is greater than the diameter of the drain flange.

10. The push-type drain assembly of claim 1, wherein the means for accommodating the length of the drain pipe between its upper end and the port comprises one or both of a coupling and a nipple.

11. The push-type drain stopper of claim 1, further comprising a strainer around the push-push mechanism, wherein the strainer has a plurality of openings.

12. A push-type drain stopper, comprising:

a push-push mechanism having upper and lower ends, wherein the push-push mechanism has two positions, wherein one position is an open position, wherein the other position is a closed position, wherein a first push on the upper end puts the push-push mechanism in the open position, and wherein a second push on the upper end puts the push-push mechanism in the closed position;

a cap attached directly or indirectly to the upper end; and a two-prong fork attached directly or indirectly to the lower end of the push-push mechanism, wherein the push-type drain stopper comprises means for accommodating or fitting in a first drain pipe having a first length and in a second drain pipe that has a second length that is different from the first length.

13. The push-type drain stopper of claim 12, wherein the push-push mechanism and the cap each have a diameter, and wherein the diameter of the cap is greater than twice the diameter of the push-push mechanism.

14. The push-type drain stopper of claim 12, wherein the push-push mechanism comprises a coupling attached to the lower end and a nipple attached to the coupling, and wherein the two-prong fork is attached to the nipple.

15. The push-type drain stopper of claim 12, further comprising a strainer around the push-push mechanism, wherein the strainer has a plurality of openings.

16. The push-type drain stopper of claim 12, wherein the push-push mechanism comprises a hollow cylinder and a spring and ratchet mechanism inside the hollow cylinder, wherein the spring and ratchet mechanism provides the open and closed positions, and wherein the two-prong fork comprises a pair of opposing prongs that have a length, and wherein the means for accommodating or fitting in the first and second drain pipes comprises the two-prong fork.

17. The push-type drain stopper of claim 16, further comprising one or both of a coupling and a nipple attached to the hollow cylinder, wherein the two-prong fork is attached indirectly to the lower end of the push-push mechanism through the coupling and/or the nipple.

18. A push-type drain stopper, comprising:

a push-push mechanism having upper and lower ends, wherein the push-push mechanism has an extended position for holding the drain stopper in an open position and a contracted position for holding the drain stopper in a closed position, a cap attached directly or indirectly to the upper end, wherein a person pushes on the cap once to place the push-push mechanism in the extended position, and wherein another push on the cap places the push-push mechanism in the contracted position; and one or more elements attached directly or indirectly to the lower end of the push-push mechanism for accommodating or fitting in drain pipes having different lengths.

19. The push-type drain stopper of claim 18, wherein a coupling, a nipple and/or a two-prong fork is used to adjust or adapt the length of the drain stopper for accommodating or fitting in drain pipes having different lengths.

20. The push-type drain stopper of claim 19, wherein the push-push mechanism comprises a cylinder between the upper and lower ends that has a diameter, wherein the cap has a diameter, and wherein the diameter of the cap is greater than twice the diameter of the cylinder.

21. The push-type drain stopper of claim 18, further comprising one or more centralizing fins attached directly or indirectly to the push-push mechanism for positioning the drain stopper within a drain pipe.

22. The push-type drain stopper of claim 18, wherein the one or more elements includes a two-prong fork.

23. A method for converting a pop-up drain assembly in a sink or basin, which has a drain opening, to a push-type drain assembly, wherein the pop-up drain assembly has a drain body below the sink or basin at the drain opening and a drain flange above the sink or basin that is connected to an upper end of the drain body, and wherein the drain body has a pivot rod port in a side wall and a tubular stub projecting outwardly from around the port, the method comprising:

providing a rod that passes through the pivot rod port and into the drain body;

placing a push-type drain stopper through the drain opening and into the drain body; and anchoring or supporting the drain stopper with the rod, wherein the drain stopper comprises:

a push-push mechanism having upper and lower ends, wherein the push-push mechanism has open and closed positions, wherein a first push on the upper end puts the push-push mechanism in the open position, and wherein a second push on the upper end puts the push-push mechanism in the closed position; and means for the drain stopper to work or operate properly in at least two different drain bodies that have a different length between the pivot rod port and the upper end of the drain body.

24. The method of claim 23, wherein the drain stopper comprises a two-prong fork, and wherein the drain stopper is anchored to the rod with the two-prong fork.

25. The method of claim 23, wherein the drain stopper comprises a cap attached directly or indirectly to the upper end of the push-push mechanism, and wherein each of the cap and the drain flange have a diameter, and wherein the diameter of the cap is equal to or greater than the diameter of the drain flange.

26. The method of claim 23, wherein the drain stopper comprises a coupling and/or a nipple and/or a two-prong fork between the push-push mechanism and the rod.

27. The method of claim 23, wherein the means for the drain stopper to work or operate properly in at least two different drain bodies that have a different length between the pivot rod port and the upper end of the drain body comprises a combination of threaded elements that can be threaded together an additional amount to shorten the push-push mechanism and that can be threaded together a lesser amount to lengthen the push-push mechanism.

28. The method of claim 27, wherein the combination of threaded elements comprises a coupling having female threads and a nipple having male threads.

29. The method of claim 28, wherein the drain stopper comprises a two-prong fork, wherein the two-prong fork is attached to the coupling or the nipple, and wherein the drain stopper is anchored to the rod with the two-prong fork.

30. The push-type drain stopper of claim 18, wherein a coupling having female threads is attached to the lower end of the push-push mechanism, wherein a nipple having male threads is in threaded engagement with the coupling, wherein a two-prong fork having a pair of opposing prongs is attached to the nipple, wherein the opposing prongs extend downwardly from the push-push mechanism while in operation and extend nearly parallel to one another.

* * * * *